US005141141A

United States Patent [19]

Leone

[11] Patent Number: 5,141,141

[45] Date of Patent: Aug. 25, 1992

[54] BAG FOR USE ON THE BODY

[76] Inventor: Nanette Leone, 1975 W. Pacific Ave., Burbank, Calif. 91506

[21] Appl. No.: 817,320

[22] Filed: Jan. 6, 1992

Related U.S. Application Data

[63] Continuation of Ser. No. 632,025, Dec. 21, 1990, abandoned.

[51] Int. Cl.[5] ..... A45C 15/30

[52] U.S. Cl. ..... 224/222; 224/229; 224/267; 2/312

[58] Field of Search ..... 224/222, 223, 226, 228, 224/229, 250, 267; 2/300, 311, 312, 313, 314, 315; D2/625

[56] References Cited

U.S. PATENT DOCUMENTS

| | | | |
|---|---|---|---|
| 668,466 | 2/1901 | Taylor et al. | 224/228 X |
| 781,056 | 1/1905 | Duncan | 224/222 |
| 926,402 | 6/1909 | Geissler | 224/222 |
| 1,070,250 | 12/1912 | Hamburger | 224/222 |
| 1,409,866 | 3/1922 | Kendall | 224/222 |
| 1,552,420 | 9/1925 | Cripper | 224/222 |
| 1,559,210 | 10/1925 | Wetherell | 224/222 |
| 1,689,396 | 10/1928 | Lang | 224/222 |
| 1,728,365 | 9/1929 | Root et al. | 224/222 |
| 1,765,965 | 6/1930 | Cohen | 2/311 |
| 1,766,604 | 6/1930 | Cohen | 224/222 |
| 2,474,495 | 6/1949 | Pollak | 2/300 |
| 3,322,311 | 5/1967 | Honer | 224/222 |
| 4,905,881 | 3/1990 | Graber | 224/222 |
| 5,020,711 | 6/1991 | Kelley | 224/222 |

FOREIGN PATENT DOCUMENTS

| | | | |
|---|---|---|---|
| 421652 | 12/1910 | France | 224/229 |
| 9840 | of 1908 | United Kingdom | 224/222 |
| 26553 | of 1912 | United Kingdom | 224/222 |
| 191321 | of 1923 | United Kingdom | 224/222 |

*Primary Examiner*—Henry J. Recla
*Assistant Examiner*—Glenn T. Barrett
*Attorney, Agent, or Firm*—Charles Berman

[57] ABSTRACT

A bag for holding items on a human being including a garter to be secured about the thigh of the human. A pocket is formed with the garter to hold the items. A closure on an opening in the pocket to prevent removal of the items. The garter and pocket is preferably located underneath clothing. The closure is a zipper and the pocket is located between the garter and the thigh of a person.

10 Claims, 5 Drawing Sheets

BAG FOR USE ON THE BODY this is a continuation of the application Ser. No. 07/632,025, filed Dec. 21, 1990, abandoned.

BACKGROUND

This invention relates to a bag for holding items on the body of a human being. It is valuable to have a unique and attractive way for providing a pocket for holding items on the body.

Many different types of bags for use on the body are known. There is bag for use around the waist which has a strap located about the waist and a bag which can be located on the back, side or stomach of the wearer. The bag is relatively bulky and is secured on the outside of the body for access by the user.

In some cases, it is not always desirable that the pocket or bag be visible and it is not always desirable that the bag be located on the waist of the person.

It is an object of the present invention to provide a bag for holding items on the body of a person which overcomes the problems of known bags for use on the body.

SUMMARY

The present invention provides a bag for use on the body for holding items which overcomes these problems.

According to the invention, a bag for holding items on the body of a human being comprises a garter to be secured about the thigh of the person. A pocket is associated with the garter for holding the items. There are means to close the pocket thereby to prevent removal of the items from the pocket.

The garter includes preferably an elastic closed loop and the closing means is a zipper. The pocket is preferably located between the garter means and the thigh, and has a relatively narrow depth profile. In use, clothing is arranged to cover at least part of the garter and pocket. In this way, the item is relatively securely located on the body and removed from sight.

The invention is now further described with reference to the accompanying drawings.

DRAWINGS

FIG. 1 is a side view of one embodiment of the garter, the garter having a ruffle material and a pocket.

FIG. 2*a* is an opposite side view of FIG. 1.

FIG. 2*b* is a side profile of the pocket part associated with the embodiment of FIGS. 1 and FIG. 2*a*.

DESCRIPTION

Figure 9:
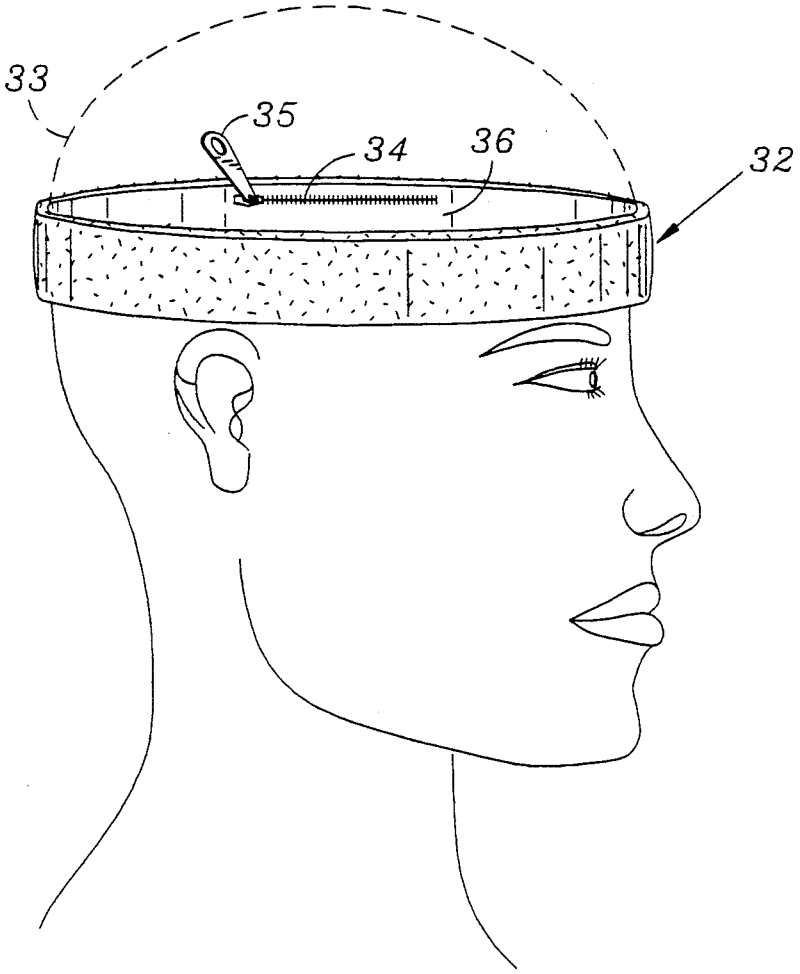
FIG. 9 is a different embodiment illustrating a band for location about the head, the band being made of a tubular toweling material and having a zipper facing inwardly.

A bag for holding items on the body of a human comprises a garter 11 to be secured about the thigh 12 of a person as is illustrated in FIG. 9. There is a pocket 13 with the garter 11 for holding the items. The pocket 13 has an opening 14 and zipper 15 closing means for the opening 14 thereby to prevent removal of the 15 items. The zipper 15 is pulled by the toggle handle 16 as necessary.

Figure 2A:
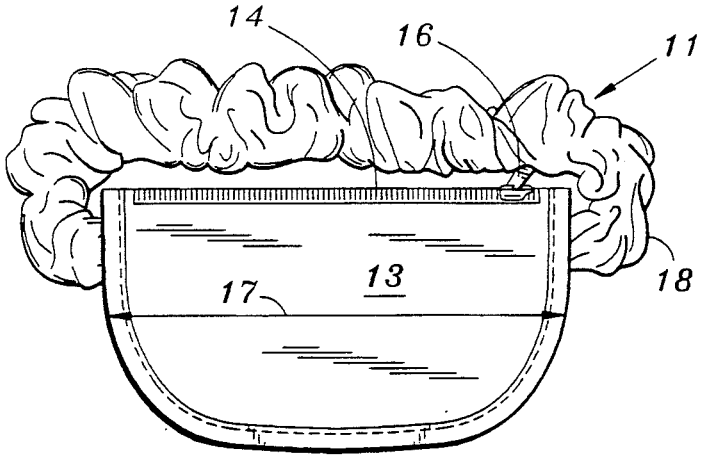
Figure 2B:
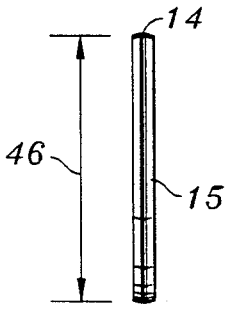

As illustrated for instance in FIG. 2*b*, the pocket has a depth profile 15 relatively narrow compared to the height as indicated by arrow 46 and the length is indicated by arrow 17 in FIG. 2*a*.

Figure 1:
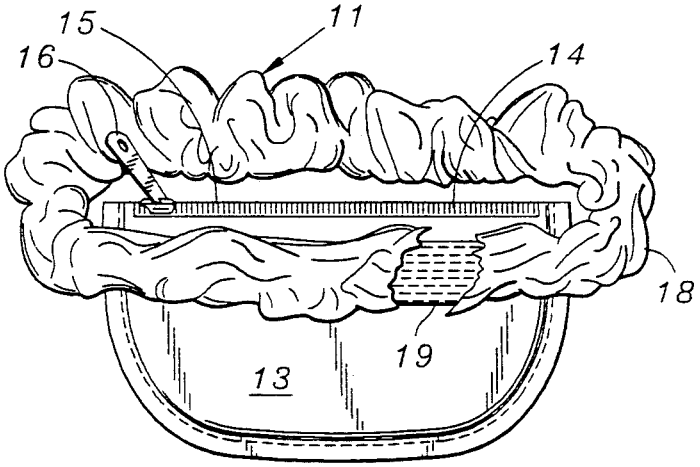

The garter 11 is a closed loop and the pocket 13 depends from the inside side of the garter 11 which would be adjacent the thigh 12. As illustrated in FIG. 1, the garter 11 includes a frill or pleated material 18 which surrounds an elasticized material 19. In the example illustrated in FIG. 5 and 6, the material is a satin fabric with an ornate pattern 20.

Figure 7:
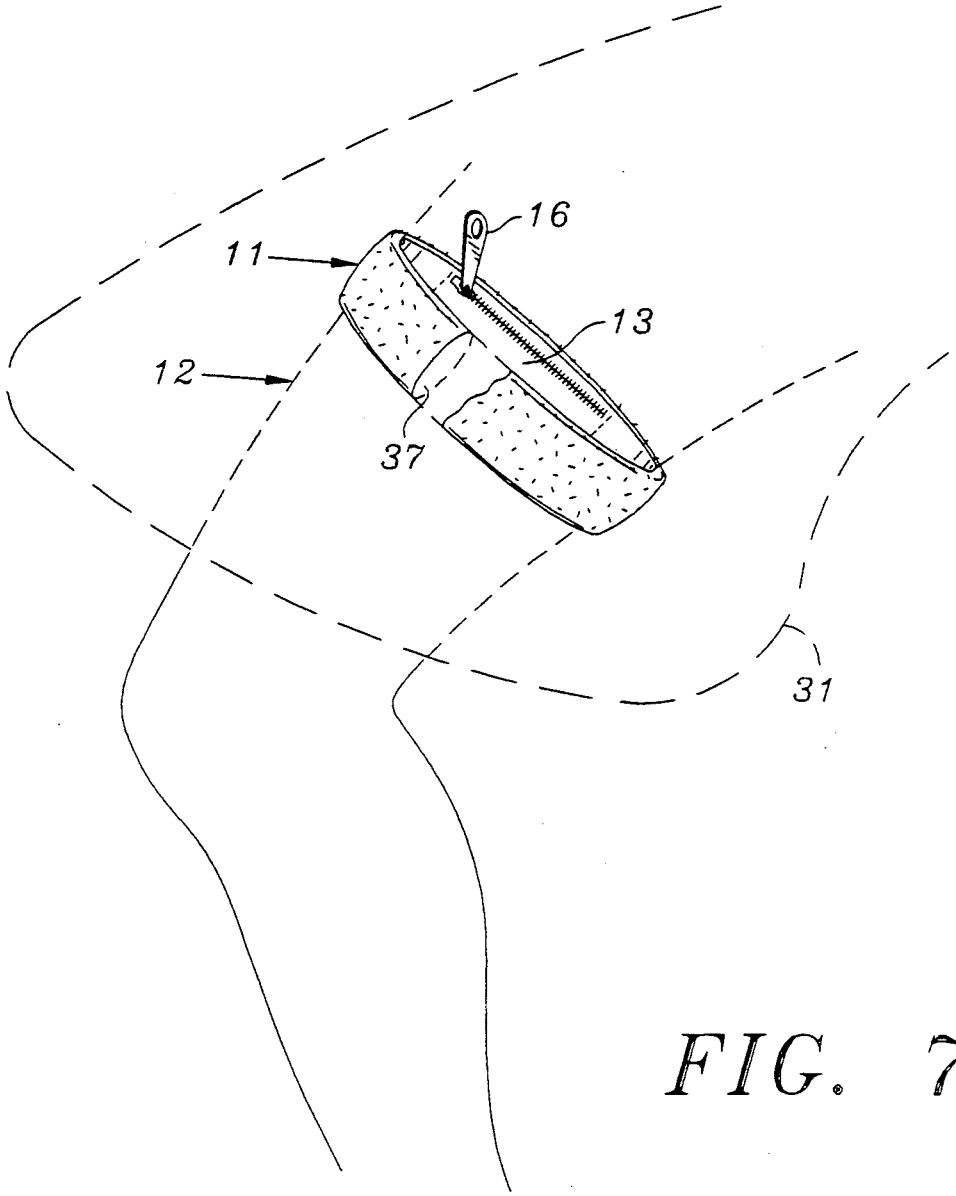
FIG. 7 is a fourth embodiment of a garter made of toweling material and having a zipper for location in the tubular material of the garter.
Figure 8:
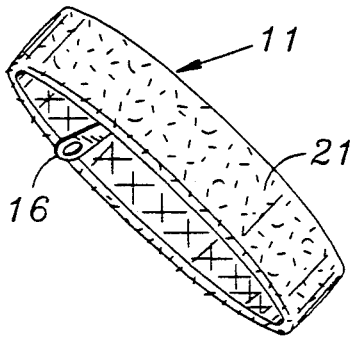
FIG. 8 is an opposite side view of FIG. 7.

As illustrated in FIGS. 7 and 8, the material has a toweling surface 21. The garter 11 of FIGS. 7 and 8 is a tubular profile.

Figure 3:
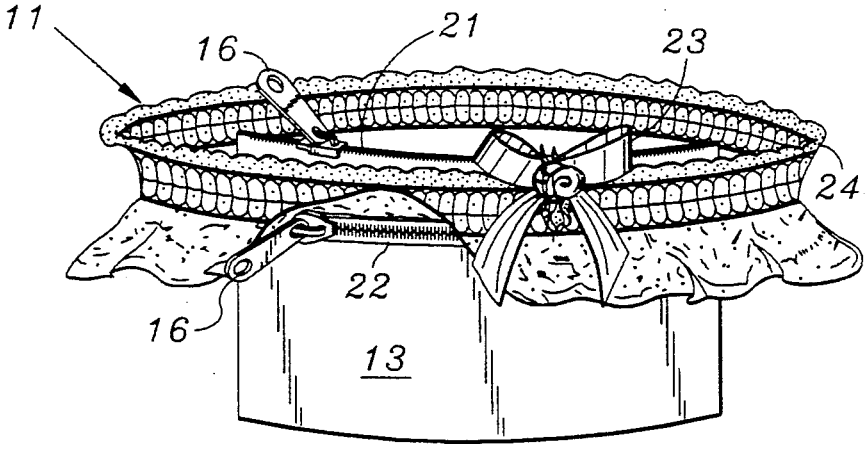
FIG. 3 is a side view of a second embodiment of the bag with the garter having a frill and the pocket having two compartments.
Figure 4:
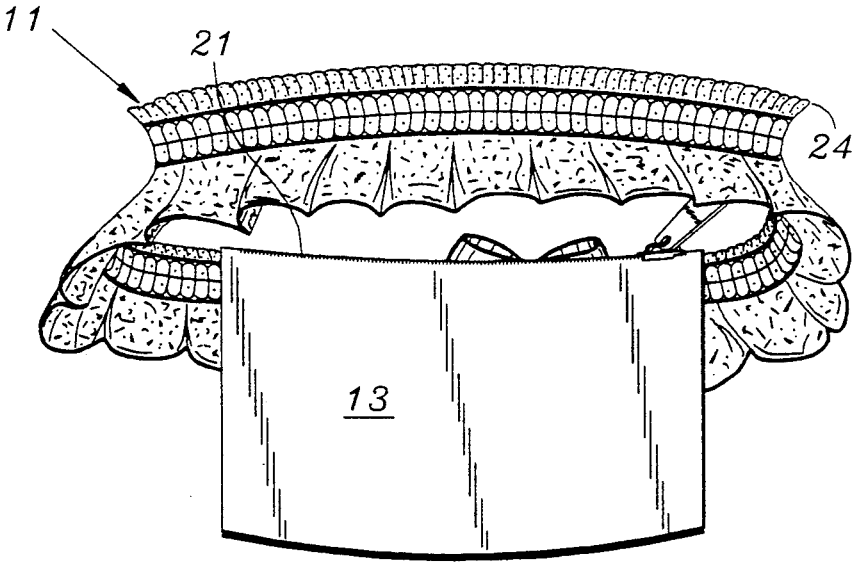
FIG. 4 is an opposite side view of FIG. 3.
Figure 5:
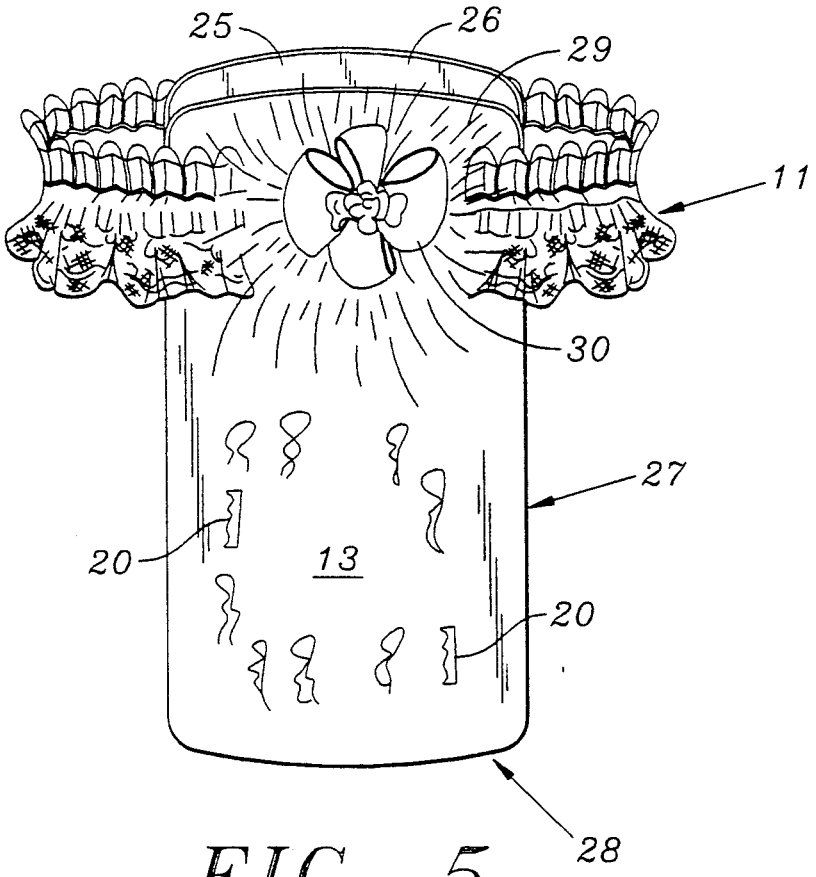
FIG. 5 is a side view of a third embodiment with the garter having a frill and the bag being closed by the garter.
Figure 6:
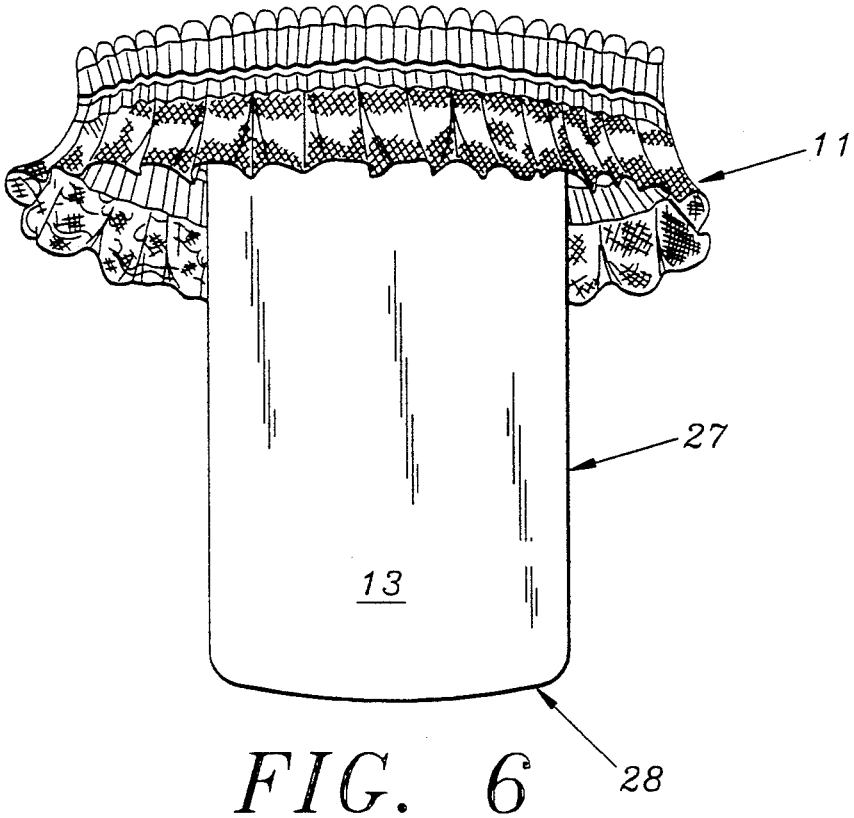
FIG. 6 is an opposite side view of FIG. 5.

In the examples of FIGS. 1, 2, 3, 4, 7 and 8, the pocket 13 is adjacent the thigh 12 and zipper 14 is used to close the pocket 13. In FIGS. 3 and 4 there are multiple pockets 13 as indicated by the two zippers 21 and 22. The two pockets 13 lie in adjacency with each other. In FIG. 3 the garter 11 includes a bow ribbon 23 as part of the frill material 24 forming the garter In the example of FIGS. 5 and 6, the pocket 13 is closed by the action of the garter 11 on the opening 25 to the mouth 26. In the embodiments of FIGS. 5 and 6 the height 27 of the garter 11 is relatively larger than the length 28 of the garter 11. A similar narrow profile depth is used as is illustrated in FIG. 2*b*. In this manner, the closing means for the mouth of the opening of FIGS. 5 and 6 is part of the garter 11. A fur-type ornamentation 29 is used with a floral decoration 30 as part of the garter 11.

In the embodiments of FIGS. 1, 2*a*, 2*b*, 3, 4, 5, 6, 7 and 8 the pocket 13 is held adjacent to the thigh 12. It is covered by clothing 31 as is illustrated in FIG. 7 in an illustrative embodiment of FIG. 7. In other cases, the embodiments of the other FIGS. 1 to 6 would likewise be covered by clothing 31 as illustrated in phantom by line 31. In this manner, the bag is at least partially hidden from sight and is secure on the body of the wearer. Access to the openings achieved rather by lifting the clothing 31 or lowering the garter 11 down the leg. In all cases, the pocket 13 is secured adjacent to the body and provides a bag for use on the body in a manner which provides security to the wearer.

In different cases, the pocket is incorporated in the garter as is illustrated in the embodiment of FIGS. 7 and 8. By having the garter 11 formed of a toweling material 21, a sweat band effect can be achieved. The tubular garter effect 37 is illustrated in part in FIG. 7 in a broken away view. Also, in different cases the frill material constituting the garter can itself be elasticized according to the characteristics of the material.

Figure 10:
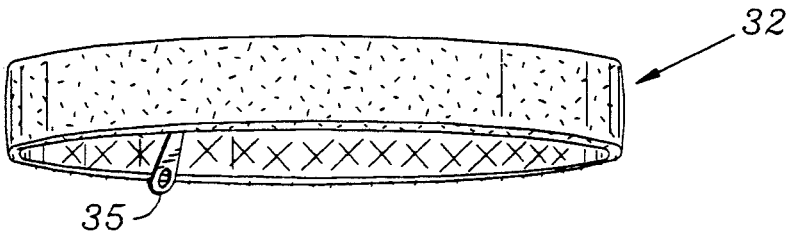
FIG. 10 is an opposite side view of FIG. 9.

In the embodiment illustrated in FIGS. 9 and 10, the bag for use on the body includes a band 32 for location on the head 33 of a human. The zipper 34 is located adjacent the head and the toggle 35 can be located between the band 32 and the head 33. The band 32 of toweling in the illustrated embodiment can serve the purpose of a sweat band. As illustrated in FIGS. 9 and 10 the diameter of the band 32 is sufficient to fit around the head. The toweling material 32 may be sufficiently sized to ensure security by having the pocket 36 adjacent the head. Thus it is secure from sight to outsiders. The pocket 36 is part of the band 32 which is at least in part a tubular material.

In the embodiments illustrated in FIGS. 1–8, the diameter of the band 32 is selected to fit about a human thigh.

Many other forms of the invention exist each differing from the other in matters of detail only. Materials which can be used for the garter and pocket include cotton, leather, satin, polyester, rayon, vinyl or combinations of these materials. Different patterns or ornamentations can be used. The closing means can be different such as velcro, clip or stud means.

The invention is to be considered limited only by the scope of the following claims.

I claim:

1. A bag for holding items on the body of a human comprising a garter adapted to be secured about a thigh of the human, at least two pockets attached to the garter for holding items therein, each pocket defined by planar side walls and positioned with respect to each other such that they are in substantial adjacent relationship with the sidewalls at least partly overlying each other, each of said at least two pockets having a top edge and access opening, the opening on one of said pockets being located at the top edge of the pocket and the opening on the other of said pockets being located on aside wall of that pocket opposite said adjacent sidewalls on each pocket for closing the openings for preventing removal of the items from the pockets, said pockets being positioned on said garter such that both of said course means are hidden from view by the garter when the garter is located about the thigh.

2. A bag for holding items on the body of a human comprising a garter adapted to be secured about a thigh of the human, at least two pockets attached to the garter for holding items therein, each pocket defined by planar side walls and positioned with respect to each other such that they are in substantial adjacent relationship with the sidewalls at least partly overlying each other, each of said at least two pockets having a top edge and access opening, the opening on one of said pockets being located at the top edge of the pocket and the opening on the other of said pockets being located on a sidewall of that pocket opposite said adjacent sidewalls, and zipper means on each pocket for closing the openings for preventing removal of the items from the pockets, said pockets being positioned on said garter such that both of said zipper means are hidden from view by the garter when the garter is located about the thigh.

3. A bag as claimed in claim 2 wherein the garter is a closed loop.

4. A bag as claimed in claim 2 wherein at least one pocket is part of the garter.

5. A bag as claimed n claim 2 wherein at lest one pocket depends on one side of the garter.

6. A bag as claimed in claim 2 including multiple pockets.

7. A bag as claimed in claim 2 wherein the garter is selectively made of material having selectively at least one of an ornate pattern, a frill, pleating, toweling effect or satin effect.

8. A bag as claimed in claim 2 wherein the garter is elasticized.

9. A bag as claimed in claim 2 wherein the garter is elasticized, and at lest on pocket defines a narrow depth profile relative to the pocket length and pocket thigh.

10. A method of holding items in a bag on a body of a human comprising locating a garter about the thigh of he human, the garter having at least two pockets for holding the items therein and each pocket having an access opening, locating items in each pocket through said access openings, wherein the opening on one pocket is located on a top edge of the pocket, and the opening on the other pocket is located on a sidewall of the pocket, closing the access openings by closure means for preventing removal of the items, covering the closure means at least partially by the garter or an extension of the garter such that said closure means are hidden from view, and covering the garter and pockets at least partially with clothing to hide at least partially the garter and pocket from view.

* * * * *